US006296351B1

(12) United States Patent
Tanaka et al.

(10) Patent No.: US 6,296,351 B1
(45) Date of Patent: Oct. 2, 2001

(54) INK JET RECORDING HEAD WITH NARROWED RESERVOIR ENDS

(75) Inventors: Ryoichi Tanaka; Tsuyoshi Kitahara; Noriaki Okazawa; Hitotoshi Kimura; Takayuki Iijima, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/372,047

(22) Filed: Aug. 11, 1999

(30) Foreign Application Priority Data

Aug. 21, 1998 (JP) ..... 10-235356

(51) Int. Cl.[7] ..... B41J 2/045

(52) U.S. Cl. ..... 347/68; 347/92; 347/70; 347/71

(58) Field of Search ..... 347/68, 70, 71, 347/84–87, 92

(56) References Cited

U.S. PATENT DOCUMENTS

| | | | | |
|---|---|---|---|---|
| 4,589,000 | * | 5/1986 | Koto et al. . | |
| 4,628,333 | * | 12/1986 | Terasawa | 347/87 |
| 4,689,641 | * | 8/1987 | Scardovi et al. . | |
| 5,412,412 | | 5/1995 | Drake et al. | 347/40 |
| 5,455,615 | | 10/1995 | Burr et al. | 347/92 |
| 5,555,238 | * | 9/1996 | Miyazawa | 347/86 |
| 5,642,144 | * | 6/1997 | Plotkin | 347/87 |
| 5,896,149 | * | 4/1999 | Kitahara et al. | 347/70 |
| 5,956,058 | * | 9/1999 | Momose et al. | 347/71 |
| 6,048,053 | * | 4/2000 | Kamoi et al. | 347/70 |
| 6,139,132 | * | 10/2000 | Yasukawa et al. | 347/70 |

FOREIGN PATENT DOCUMENTS

| | | | | |
|---|---|---|---|---|
| 529 879 A1 | * | 3/1993 | (EP) | 347/87 |
| 683050A2 | * | 11/1995 | (EP) . | |
| 695638 | | 2/1996 | (EP) . | |
| 5-96744 | * | 4/1993 | (JP) | 347/86 |
| 9-226112 | | 9/1997 | (JP) | B41J/2/045 |

OTHER PUBLICATIONS

Patent Abstracts of Japan, JP 61 100469 A, May 19, 1986.

* cited by examiner

*Primary Examiner*—Benjamin R. Fuller
*Assistant Examiner*—C. Dickens
(74) *Attorney, Agent, or Firm*—Sughrue, Mion, Zinn, Macpeak & Seas, PLLC

(57) ABSTRACT

In order to ease the discharge of air bubbles stagnated in end portions of a reservoir in an ink jet recording head, the end portions of the reservoir are so formed that the widths thereof are substantially equal to the depths thereof. Air bubbles entered in those portions are drawn into pressure generating chambers by directly applying negative pressure to discharge outwards from nozzle orifices.

11 Claims, 10 Drawing Sheets

INK JET RECORDING HEAD WITH NARROWED RESERVOIR ENDS

BACKGROUND OF THE INVENTION

The present invention relates to an ink jet recording head for ejecting ink droplets onto a recording medium to form an image, and in particularly to the structure of a spacer for forming a channel for a pressure generating chamber and a reservoir.

As is disclosed in, for example, Japanese Patent Publication No. 9-226112A, an ink jet recording head comprises: arrays of pressure generating chambers; a channel unit that is formed by laminating a spacer, in which a reservoir is formed that communicates with the pressure generating chambers via ink supply ports, a nozzle plate, in which nozzle orifices are formed to communicate with the pressure generating chambers, and an elastic plate for sealing the pressure generating chambers and the reservoir; a pressure generating member for deforming the elastic plate in an area opposite the pressure generating chamber; and a head holder, including an ink guide passage along which ink is introduced into the reservoir, for fixing the channel unit to the pressure generating member.

In such an ink jet recording head, ink from an external ink container is supplied to the reservoir, and is transferred to the pressure generating chambers via the ink supply ports. Pressure is applied to the ink in the pressure generating chambers by the pressurization means and is ejected as ink droplets at the nozzle orifices.

When an empty ink container, normally, an empty ink cartridge, is replaced by a new one, air bubbles enter into the reservoir and block the ink supply ports, so that ink droplets can not be ejected. Thus, to discharge air bubbles from the reservoir, the nozzle plate is closed with a cap member and ink is forcibly discharged from the reservoir by the application of a negative pressure produced by a suction pump.

However, since the negative pressure produced by the suction pump causes a flow of ink in the reservoir, pressure gradient occurs from the center portion of the reservoir to the end portion thereof. Then, some of the air bubbles that entered the reservoir are prevented from flowing across the wall of the reservoir into the ink supply ports that are located in the center portion of the reservoir, and instead, are moved along the side wall of the reservoir to the end portion and are retained there.

Since at the end portion of the reservoir the amount of ink flow per unit area is smaller than at the center portion, the force available for the discharge of air bubbles is so small that the air bubbles retained at the end portion of the reservoir are difficult to remove.

SUMMARY OF THE INVENTION

It is therefore one objective of the present invention to provide an ink jet recording head capable of easily discharging air bubbles retained at the end portion of a reservoir.

To achieve the above objective, according to the present invention, an ink jet recording head comprises: arrays of pressure generating chambers; a reservoir formed by a spacer that communicates with the pressure generating chambers of the arrays via ink supply ports; a channel unit formed of a nozzle plate in which nozzle orifices are formed that communicate with the pressure generating chambers, an elastic plate and the spacer; and pressurization means for applying pressure to the ink in the pressure generating chambers, wherein the reservoir is so tapered so that the end portion of the reservoir is substantially as wide as the depth.

Since the suction force provided for the many ink supply ports acts on the air bubbles that have entered the end portion of the reservoir, the air bubbles are easily drawn into the pressure generating chambers across the wall of the reservoir, and are discharged outwards from the nozzle orifices.

DETAILED DESCRIPTION OF THE PREFERRED EMBODIMENTS

The preferred embodiment of the present invention will now be described while referring to the accompanying drawings.

Figure 1:
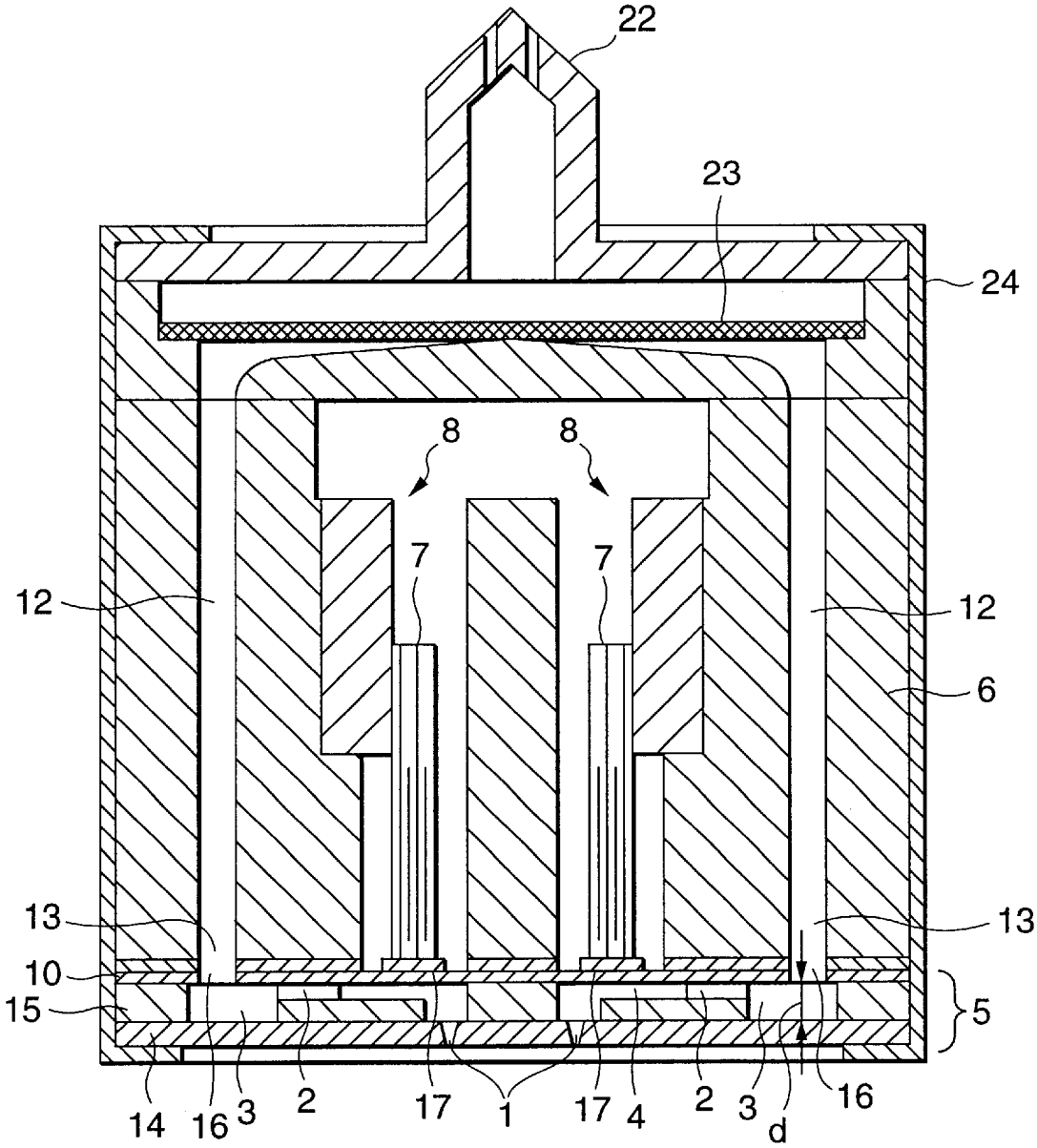
FIG. 1 is a cross-sectional view of an ink jet recording head according to one embodiment of the present invention.

FIG. 1 is a diagram showing an ink jet recording head according to a first embodiment of the present invention. Nozzle orifices 1, ink supply ports 2, reservoirs 3 and pressure generating chambers 4 are formed that together constitute a channel unit 5 fixed to one end portion of a head holder 6. A piezoelectric vibrator unit 8 is secured to the head holder, so that the distal ends of piezoelectric vibrators 7 contact with the channel unit 5 at positions corresponding to the respective pressure generating chambers 4.

Figure 2:
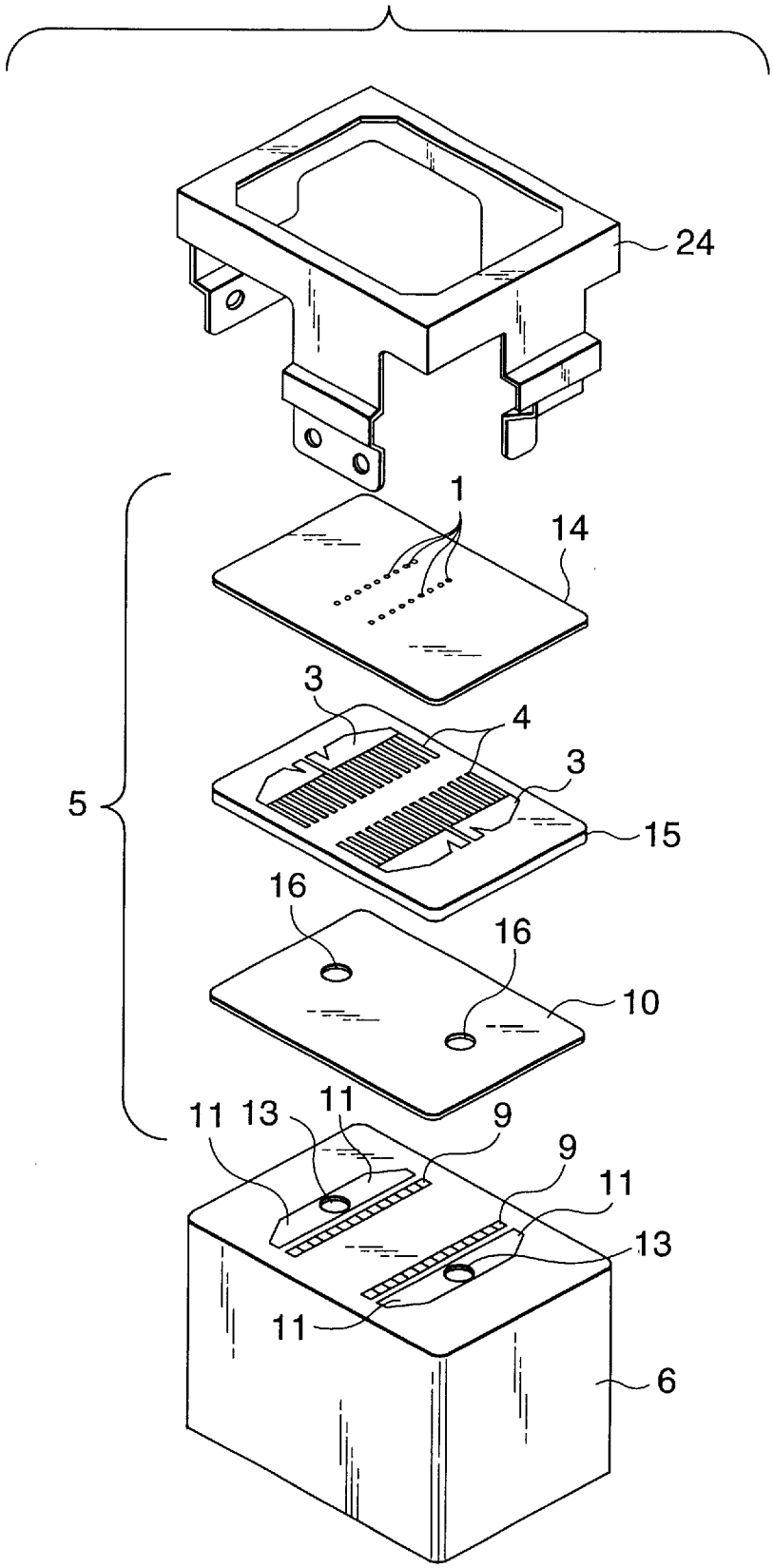
FIG. 2 is a perspective view of the assembly of the ink jet recording head of the present invention.

As is shown in FIG. 2, to constitute the head holder 6, windows 9 are formed at positions adjacent to the pressure generating chambers 4 to expose the ends of the piezoelectric vibrators 7 located therein, recessed portions 11 are formed in areas corresponding to the reservoirs 3 to facilitate the deformation of an elastic plate 10, and openings 13 for ink guide passages 12 are formed at locations corresponding to the central positions of the reservoirs 3.

The channel unit 5 comprises: a nozzle plate 14, in which are formed the nozzle orifices 1 that communicate with the pressure generating chambers 4; a spacer 15, in which are formed the reservoirs 3, the ink supply ports 2 and the pressure generating chambers 4; and an elastic plate 10, which is composed of an elastic film and which can be deformed in areas corresponding to the reservoirs 3 and the pressure generating chambers 4, for at the least sealing the reservoirs 3, the ink supply ports 2 and the pressure generating chambers 4, and wherein through holes 16 are formed to connect the openings 13 in the head holder 6 to the reservoirs 3.

On the elastic plate 10, island portions 17 having high stiffness are formed along the center line of each pressure generating chamber 4 in order to widely vary the volume of the pressure generating chamber 4. The distal ends of the piezoelectric vibrators 7 abut upon the island portions 17.

Figure 3:
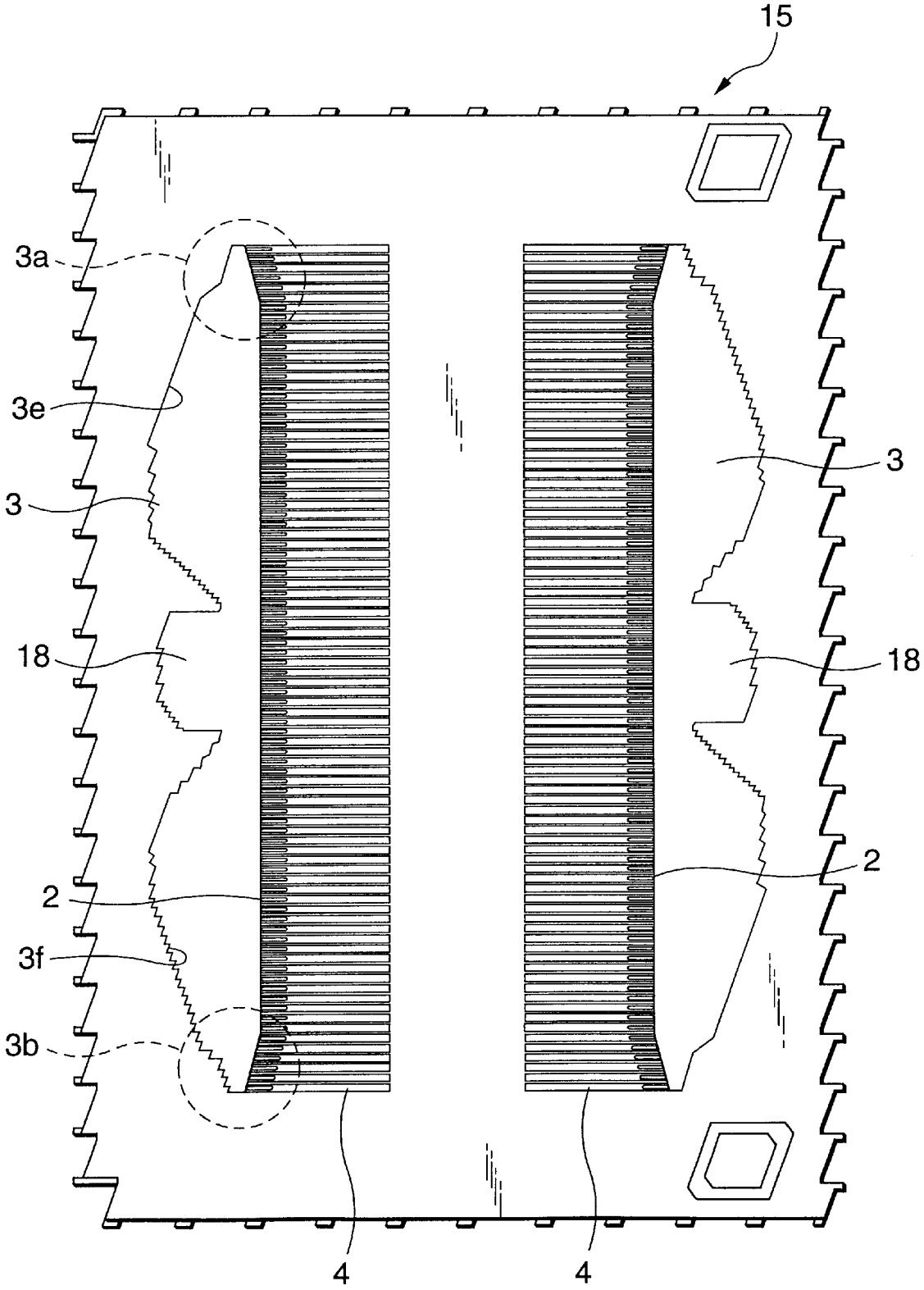
FIG. 3 is a plan view of a spacer according to a first embodiment of the present invention.

FIG. 3 is a diagram showing a spacer 15 of this embodiment. Two arrays of pressure generating chambers 4 are symmetrically formed at constant pitches along the center line, the reservoirs 3 are independently formed outside the each array of the pressure generating chambers 4, and the ink supply ports 2 are so formed as to connect the reservoirs 3 to the pressure generating chambers 4 of the each array. In this embodiment, the ink supply ports 2 are formed by extending the partition walls defining the pressure generating chambers 4 up to the boundaries of the reservoirs 3 and by forming middle ground areas between the partition walls.

The reservoirs 3, which are shaped like wings and which extend symmetrically from the openings 13 of the ink guide passage 12 so that at both sides they are slightly narrowed, communicate with the ink channels 12 via recessed portions 18 formed at their centers.

Figure 4A:
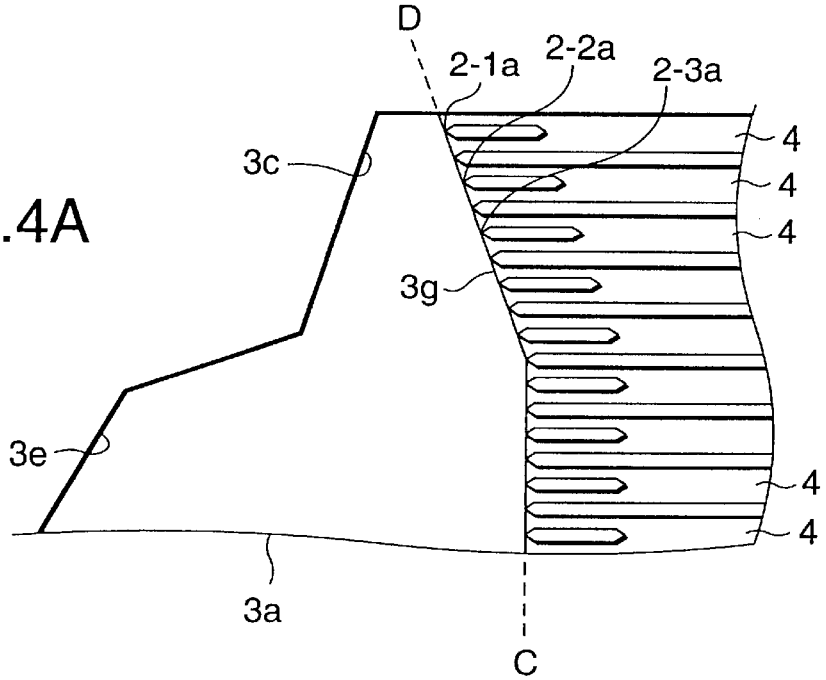
FIGS. 4A and 4B are enlarged views showing areas 3*a* and 3*b* in FIG. 3.
Figure 4B:
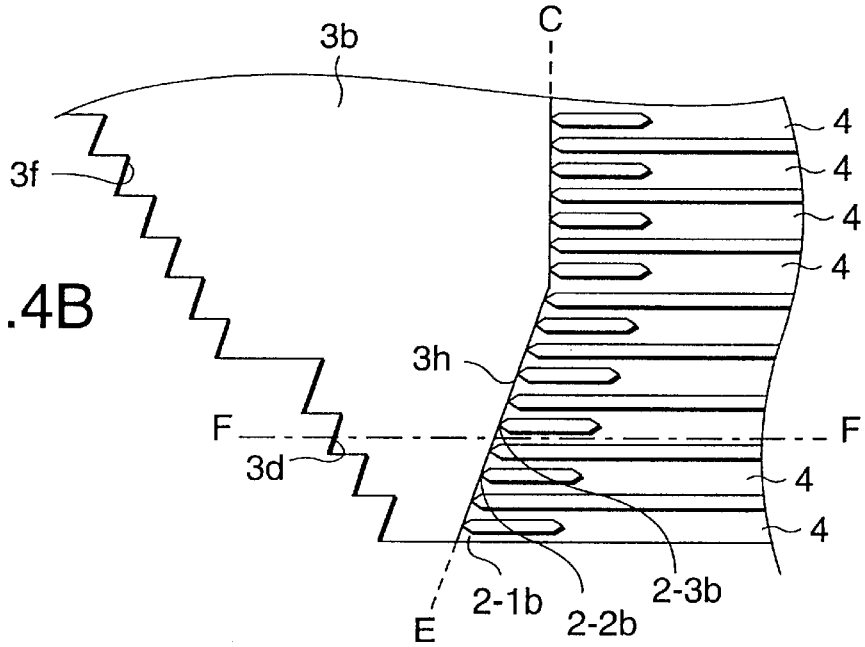

As is shown in FIGS. 4A and 4B, areas 3*a* and 3*b*, at both end portions of each reservoir 3, are so formed that walls 3*c* and 3*d* are closer to the ink supply ports 2 than walls 3*e* and 3*f* located in the central portion of the reservoir 3.

Figure 4C:
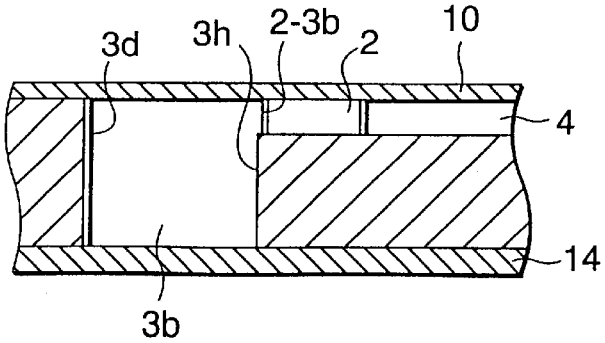
FIG. 4C is a cross-sectional view taken along the line F—F of FIG. 4B.

In this embodiment, as is shown in FIG. 4C, at the locations of the end portions 3*a* and 3*b*, ink supply ports 2-1*a*, 2-2*a* and 2-3*a*, and ink supply ports 2-1*b*, 2-2*b* and 2-3*b* are aligned along inclined lines D and E, which form specific angles relative to center line C along which the ink supply ports 2 are arranged, so that the distal ends of the ink supply ports are located on the same face as the walls 3*g* and 3*h* of the reservoir 3, and so that the ink supply ports closer to the end portions are shifted toward the opposite walls 3*c* and 3*d* of the reservoir 3. Also, the width w (see FIG. 5A) of intervals situated between the ink supply ports 2-1*a*, 2-2*a* and 2-3*a* and the opposed wall 3*c* (the ink supply ports 2-1*b*, 2-2*b* and 2-3*b* and the opposed walls 3*d*) of the reservoirs 3, is substantially equal to the depth d (see FIG. 1) of the reservoirs 3.

As is well known, a monocrystal silicon substrate that is cut out to a predetermined thickness is employed to form the spacer 15; the reservoirs 3 and the recessed portions 18 that serve as connection portions are formed as through holes by anisotropic full etching; and recessed portions are formed by anisotropic half etching to serve as the pressure generating chambers 4 and the ink supply ports 2.

A metal or glass plate that can be etched and that is resistant to corrosion by ink may be employed to form the spacer 15, and through holes and recessed portions may be formed by etching. Or such a plate may be divided into a plurality of layers in the direction of thickness, with the bottom faces of the recessed portions serving as boundaries, and etching films in which are formed through holes that correspond to those in the individual layers, laminated thereto.

In this embodiment, the nozzle plate 14 is positioned on one side of the spacer 15, and the channel unit 5 is formed by using an adhesive to obtain a liquid-tight bond that fixes the elastic plate 10 to the other side.

The through holes 16 in the channel unit 5 are aligned with the openings 13 of the ink channels 12, and the channel unit 5 is bonded to the head holder 6 by an adhesive. Thereafter, the piezoelectric vibrator units 8 are fixed in the head holder 6 so that the distal ends of the piezoelectric vibrators 7 contact the island portions 17 on the elastic plate 10. In addition, an ink supply needle 22 and a filter 23 are attached to the other side of the head holder 6, and are secured externally by a frame body 24, which also serves as a shielding member. In this manner, an ink jet recording head is obtained.

When a drive signal is transmitted to the thus structured recording head and a charge is placed on the piezoelectric vibrators 7, they contract and cause the pressure generating chambers 4 to expand. As a result, ink in the reservoirs 3 flows through the ink supply ports 2 and into the pressure generating chambers 4. Thus, when the charge on the piezoelectric vibrators 7 is released, after a predetermined period of time has elapsed, and the length of the piezoelectric vibrators 7 is extended and they return to their original state, the pressure generating chambers 4 are compressed and part of the ink held therein is ejected as ink droplets through the nozzle orifices 1.

When the ink in an ink cartridge is exhausted and the empty ink cartridge is replaced, air bubbles are formed and enter the reservoirs 3. Therefore, the nozzle plate 14 is closed by the cap member, and using negative pressure produced by a suction pump, ink is forcibly drawn from the ink cartridge into the recording head and is discharged at the nozzle orifices 1. This process is a so-called cleaning operation.

Figure 5A:
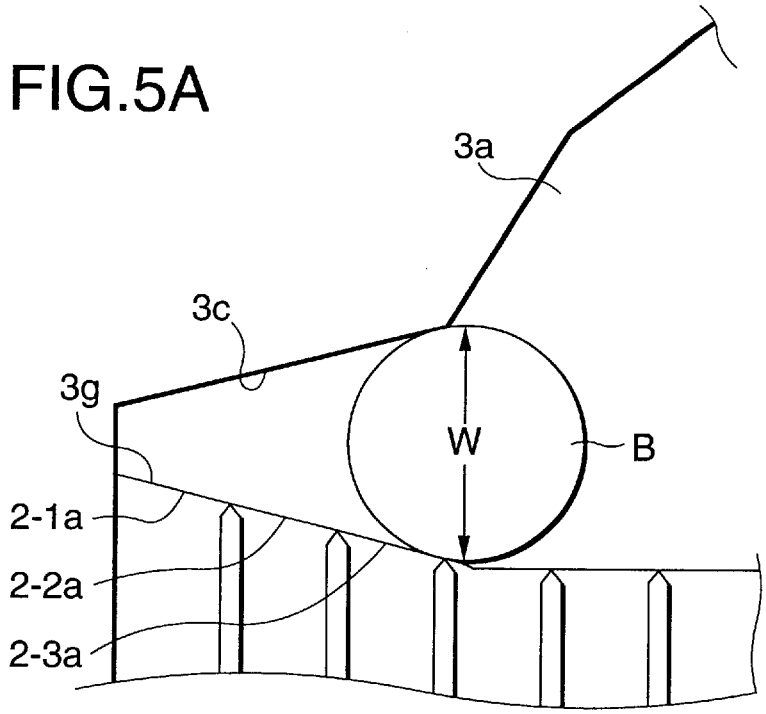
FIGS. 5A and 5B are diagrams for explaining the respective operations performed by the ink jet recording head of the present invention and by a related ink jet recording head when discharging air bubbles at the end portion of the reservoir.

Since the walls 3*c* and 3*d* are closing toward the ink supply ports 2, and the walls 3*g* and 3*h* along with the lines D and E on which the ink supply ports 2-1*a*, 2-2*a*, 2-3a, 2-1*b*, 2-2*b* and 2-3*b* are arranged are inclined from the ink supply ports 2 arranged in the central portion of the reservoir, the width of the reservoir 3 is narrowed toward the end portion thereof. Therefore, as is shown in FIG. 5A, an air bubble B existing stagnantly in the end portion 3*a* of the reservoir 3 is held by the walls 3*c* and 3*g* and the ink supply ports 2-1*a*, 2-2*a*, 2-3*a*, which compose of the narrowed portion, and seals the ports.

Thereafter, when negative pressure is applied to the ink supply ports 2-1*a*, 2-2*a*, 2-3*a*, 2-1*b*, 2-2*b* and 2-3*b*, the negative pressure acts on the air bubble B, and along with a flow of ink, it is easily drawn into the pressure generating chambers 4 and discharged outwards.

Figure 5B:
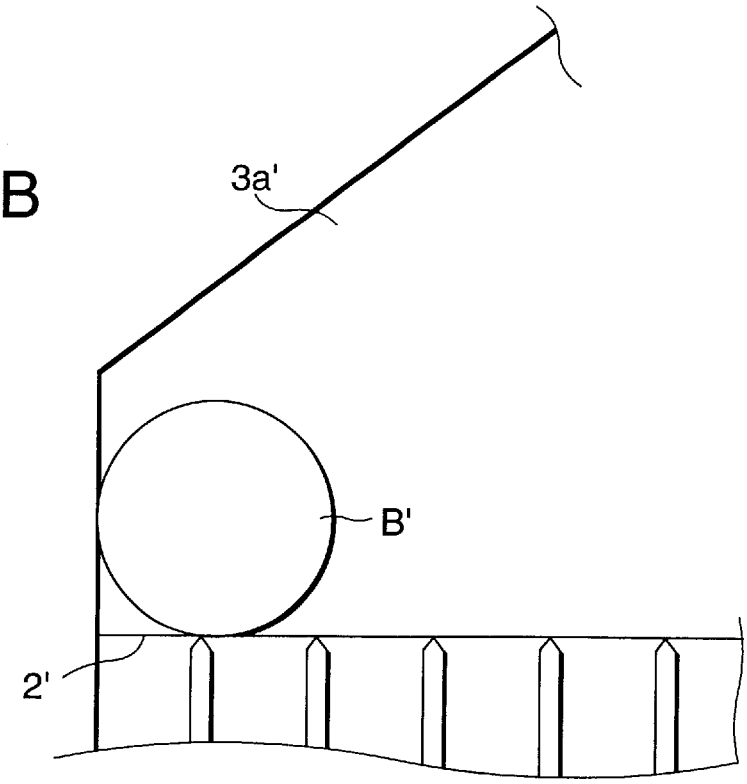

In a related ink jet recording head, however, for which end portions of a reservoir is so formed that even though it is narrowed it is larger than an air bubble, the removal of an air bubble depends on the flow of ink to an ink supply port 2', as is shown in FIG. 5B. Therefore, the negative pressure exerted on the air bubble B is low and drawing the air bubble B to the ink supply port 2' is difficult.

Figure 6:
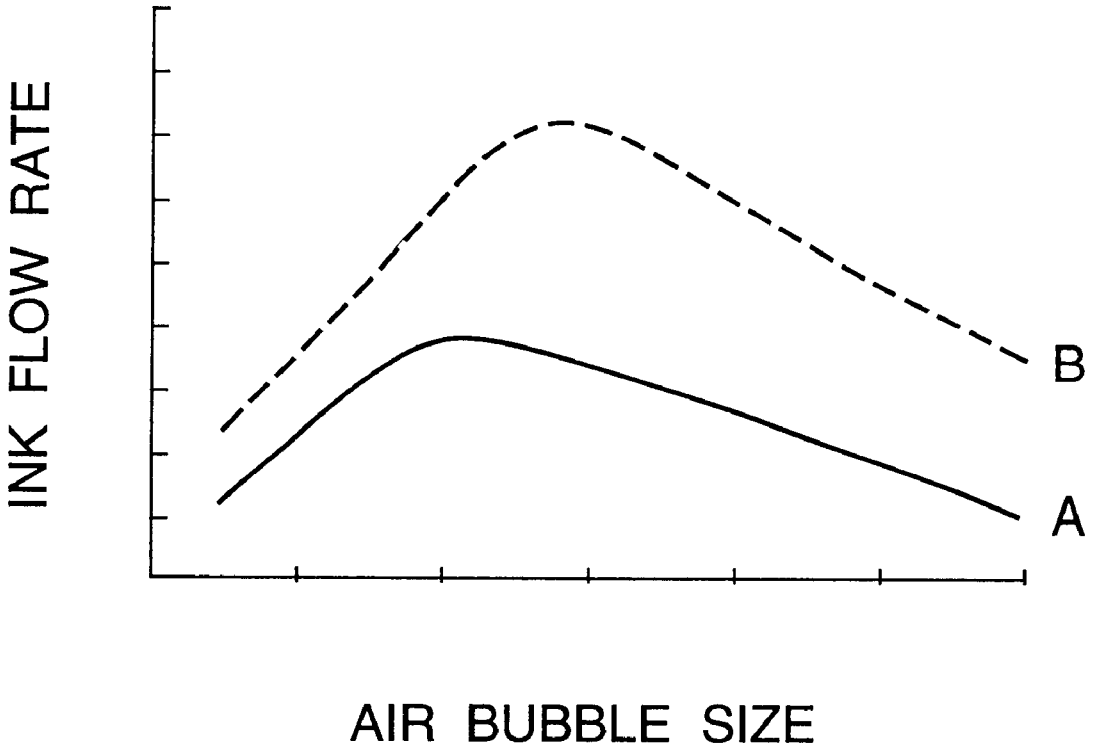
FIG. 6 is a graph showing the air bubble discharge characteristics of the ink jet recording head of the present invention and of the related ink jet recording head.

FIG. 6 is a graph showing the relationship (described by solid line A) between the size of an air bubble that entered the end portion of the reservoir of the recording head of the present invention and the flow rate that was required to remove the air bubble, as compared with the same relationship established for a related recording head (described by dashed line B). As is apparent from FIG. 6, since with the recording head of the present invention an air bubble can be drawn to and discharged from the ink supply port at an ink flow rate lower than that which is required for the related head, the amount of ink consumed when an air bubble is removed can be reduced, and the employment of only a small suction pump will provide a satisfactory result.

Figure 7A:
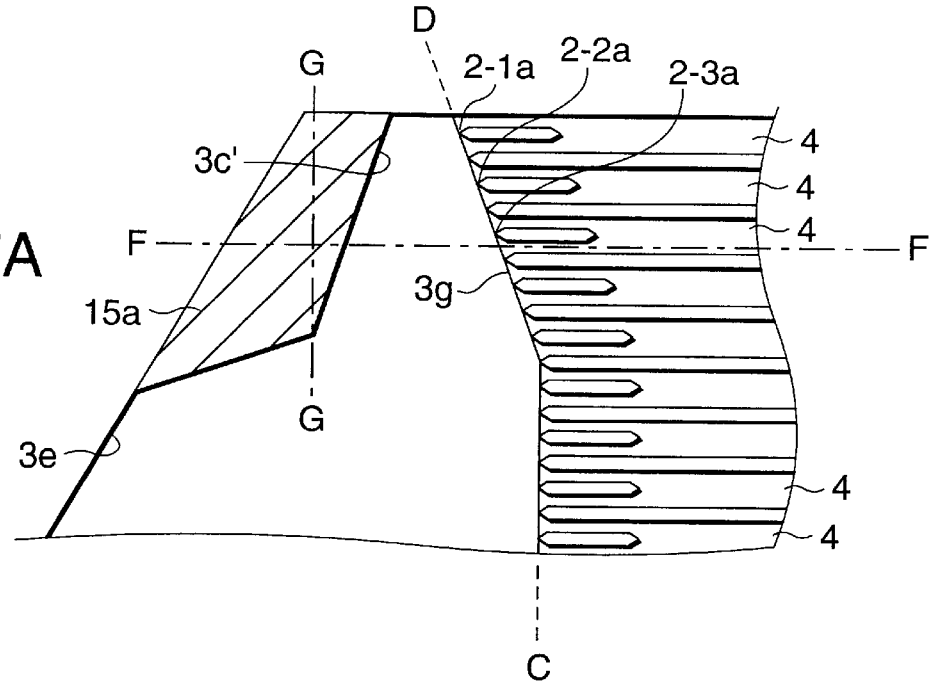
FIGS. 7A to 7C are a plan view and cross-sectional views, taken along line F—F and line G—G, of the structure at the end portion of a reservoir according to a second embodiment of the present invention.
Figure 7B:
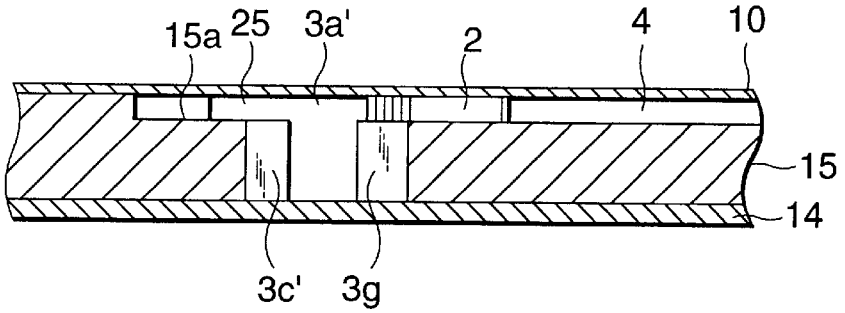
Figure 7C:
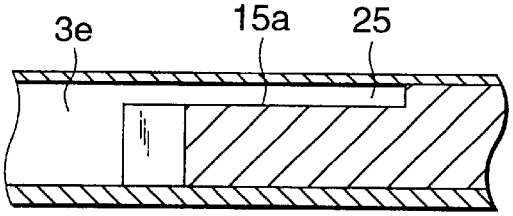

In the above embodiment, the walls 3*c* and 3*d* in the end portions 3*a* and 3*b* of the reservoir 3 are formed as thick as the central portion. To obtain the same effect, as is shown in FIGS. 7A, 7B and 7C, a wall 3*c*' can be shaped like a step 15*a*, which is formed by half etching, that is thick enough to hold an air bubble on the ink supply port side.

According to this configuration, a gap 25 is defined between the step 15*a* and the elastic plate 10, which seals the reservoirs 3, and in areas 3*a* and 3*b* this enables the elastic plate 10 to be deformed and drawn into the gap. Therefore, when a rise in the pressure at the end portions, which is caused by the reverse ink flow at the ink supply ports 2-1*a* to 2-3*a* and 2-1*b* to 2-3*b* that occurs when ink droplets are ejected by the application of pressure to the pressure generating chambers 4, such a rise is regarded as a displacement of the elastic plate 10. Therefore, this contributes to the acquisition of compliance by the end portions 3*a* and 3*b*, which tends to be low.

Figure 7D:
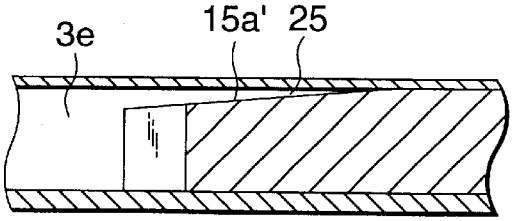
FIG. 7D is a cross-sectional view showing a modified example of the reservoir of the second embodiment.

While the gap 25 is uniformly formed in this example, as is shown in FIG. 7D, to obtain the same effect a gap may be defined that gradually becomes smaller towards the end portion of the reservoir 3.

Figure 8A:
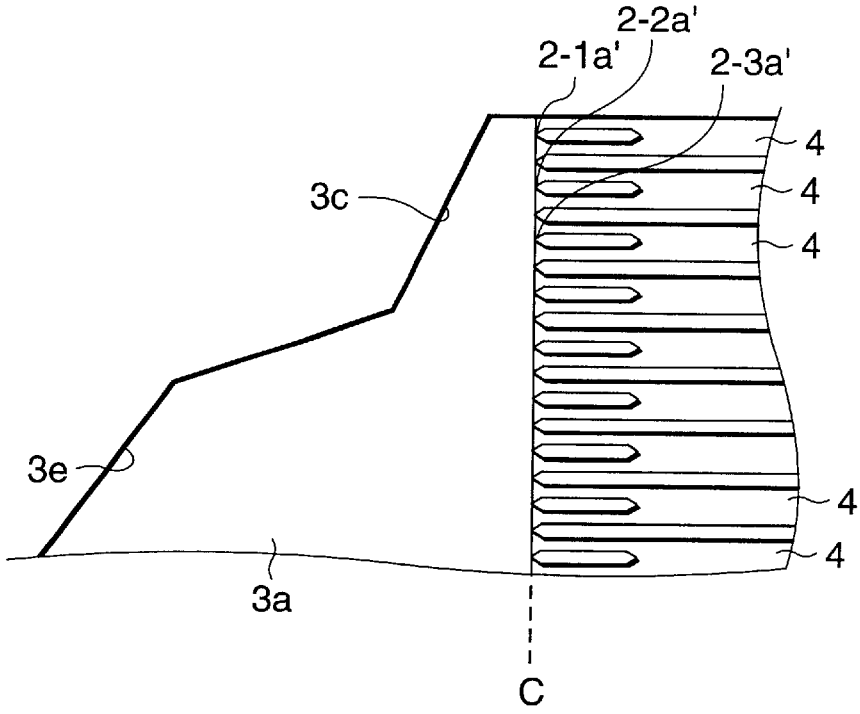
FIGS. 8A and 8B are plan views of the structure at the end portion of a reservoir according to a third and a fourth embodiment of the present invention, respectively.

In the above embodiment, the end portion 3*a* of the reservoir 3 is narrowed by making the line, along which the ink supply ports 2-1*a* to 2-3*a* are arranged, inclined relative to the center line C, along which are arranged the ink supply ports 2. However, as is shown in FIG. 8A, the end portion 3*a* may be narrowed only by the wall 3*c* while making the line, along which the ink supply ports 2-1*a*' to 2-3*a*' are arranged, aligned with the center line C.

Figure 8B:
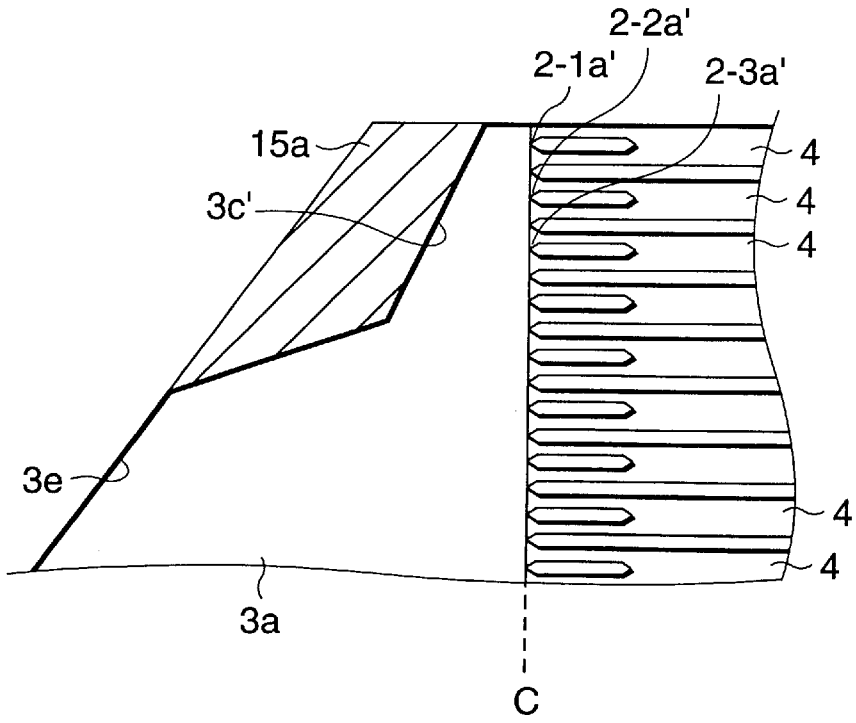

In this case, the same effect as in the above embodiment can be obtained by forming, as is shown in FIG. 8B, a step 15*a* having a wall 3*c*' that is positioned so that it lies along the same line as does the wall 3*c*.

Figure 9A:
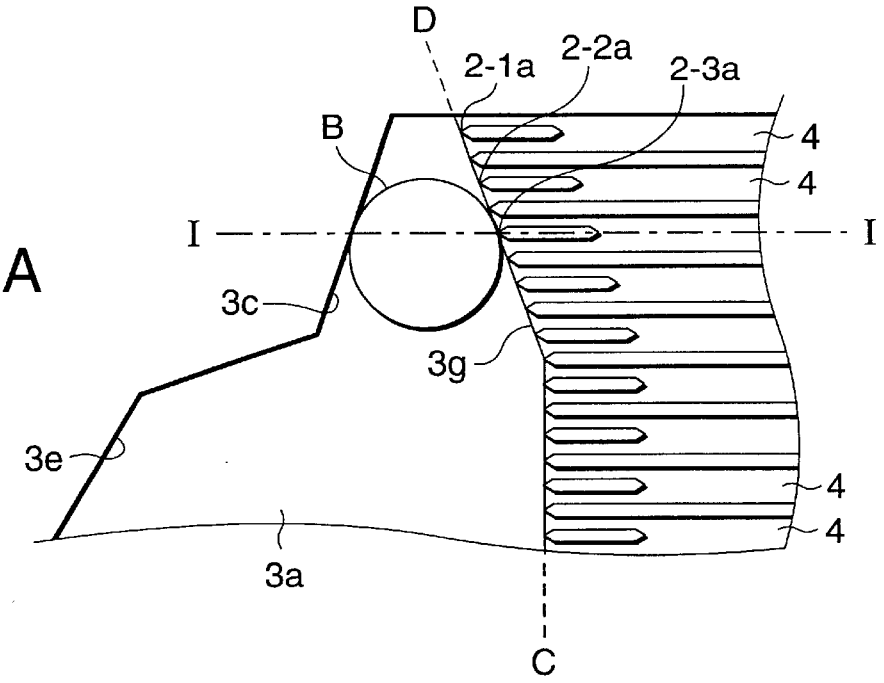
FIGS. 9A and 9B are a plan view and a cross-sectional view taken along line I—I of FIG. 9A for explaining the effect according to the structure of the present invention.
Figure 9B:
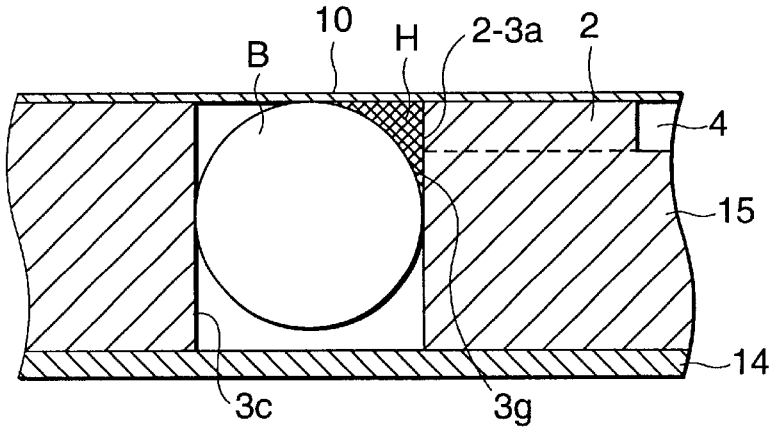

As is described above, the partition walls that define the pressure generating chambers 4 and the distal ends of the middle ground areas are matched with the wall 3*g*, or 3*h*, that defines the reservoir, and the ink supply ports 2-la, 2-2*a* and 2-3*a*, or the ink supply ports 2-1*b*, 2-2*b* and 2-3*b*, are located at the end portion of the reservoir, as is shown in FIG. 9A. Therefore, the cross section H of the area can be smaller than that which is defined by an air bubble that is stagnantly held in the area 3*a* or 3*b* of the reservoir 3, which is defined by the elastic plate 10, the wall 3*g* of the reservoir 3 and the distal ends of either the ink supply ports 2-1*a*, 2-2*a* and 2-3*a* or the ink supply ports 2-1*b*, 2-2*b* and 2-3*b*, and the ink flow rate can be increased. Thus, an air bubble B is easily carried along the wall 3*g* (3*h*) of the reservoir 3, and is drawn into the pressure generating chamber 4 and discharged at the nozzle orifice 1.

Figure 9C:
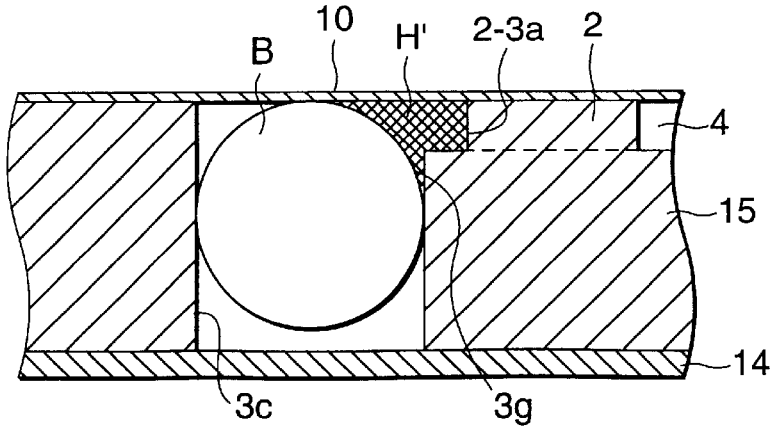
FIG. 9C is a cross-sectional view of a related structure used to explain the effect obtained by the present invention.

Specifically, the ink supply ports 2-1*a*, 2-2*a* and 2-3*a*, and the ink supply ports 2-1*b*, 2-2*b* and 2-3*b*, are so formed that, as is shown in FIG. 9C, the partition walls that define the pressure generating chambers 4 and the middle ground areas are moved back from the wall 3*g*, or 3*h*, that defines the reservoir 3. As a result, an enlarged cross section H' is provided of the area that is defined by an air bubble, which is stagnantly positioned in the end portion 3*a*, or 3*b*, of the reservoir 3, and the elastic plate 10, the wall 3*g*, or 3*h*, of the reservoir 3 and the distal ends of either the ink supply ports 2-1*a*, 2-2*a* and 2-3*a* or the ink supply ports 2-1*b*, 2-2*b* and 2-3*b*. As a result, it is difficult for the air bubble B to pass over the wall 3*g*, or 3*h*, of the reservoir 3, and to be discharged from the nozzle orifice 1.

Figure 10A:
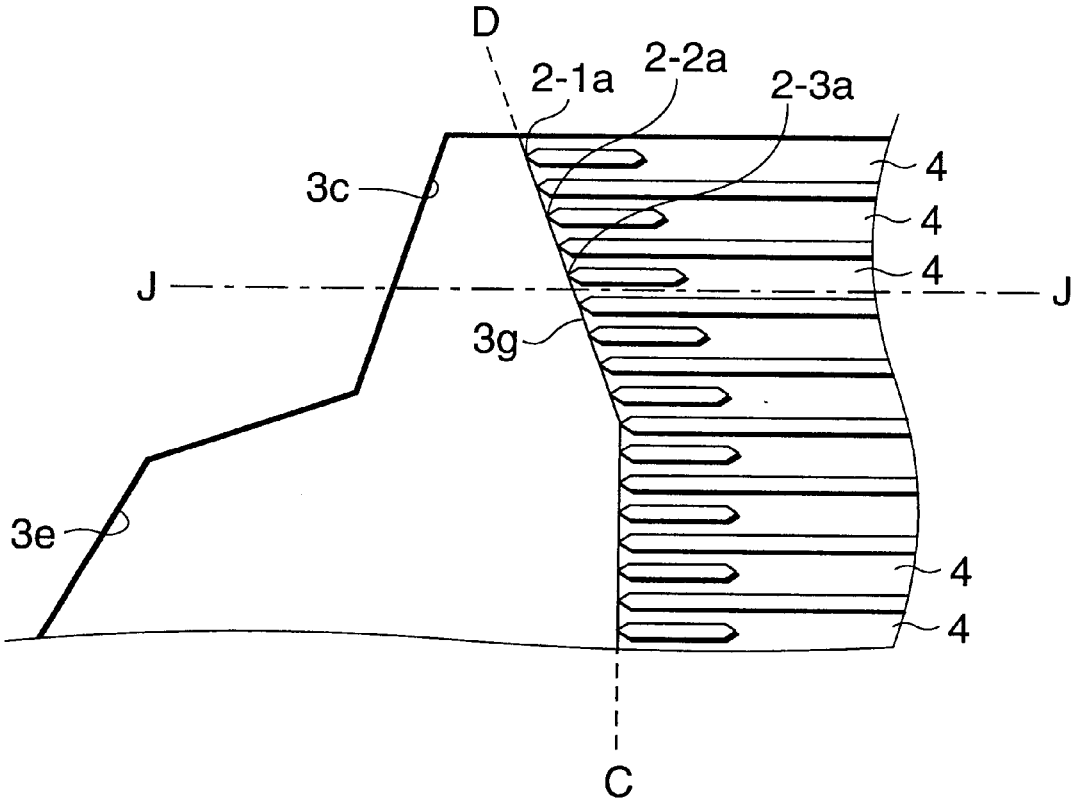
FIGS. 10A and 10B are a plan view and a cross-sectional view of line J—J of the structure at the end portion of a reservoir according to a fifth embodiment of the present invention.
Figure 10B:
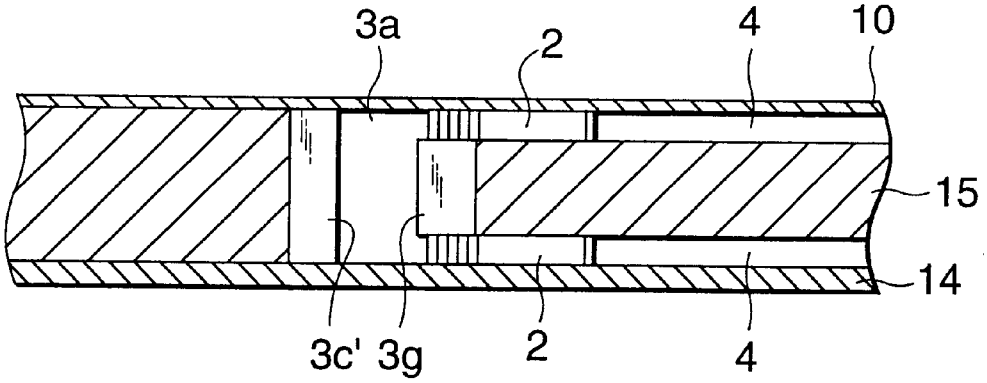

In the above embodiment, the ink supply ports 2 are formed only on a side of the elastic plate 10. As is shown in FIGS. 10A and 10B, the same effects can be obtained when ink supply ports 2 are formed on both facing plate sides, i.e., the sides of the elastic plate 10 and of the nozzle plate 14.

In the embodiment, in order to apply pressure to ink, the volume of a pressure generating chamber is changed by contracting and extending a piezoelectric vibrator. Therefore, since the present invention relates to the discharge of an air bubble at the end portion of the reservoir by drawing out ink by applying a negative pressure to a recording head, the pressurization method employed for the pressure generating chambers is not related to the discharge of an air bubble. Thus, it is apparent that the same effect can be obtained when the present invention is applied to the reservoir of a recording head that employs, as pressure generation means, a heating element that heats and evaporates ink in pressure generating chambers.

As is described above, according to the present invention, since the width of the end portion of a reservoir is so narrowed as to be substantially equal to the depth thereof, an air bubble that has progressed to the end portion of the reservoir is held in contact with ink supply ports, and is drawn into a pressure generating chamber by the application of a negative pressure to the ink supply ports. As a result, an air bubble can easily be discharged outwards.

What is claimed is:

1. An ink jet recording head comprising:

a channel unit including a spacer defining a reservoir, arrays of pressure generating chambers and ink supply ports, the arrays of pressure generating chambers so formed as to respectively communicate with the reservoir via the associated ink supply ports; and pressurization means for applying pressure to ink within the pressure generating chambers, wherein at least one end portion of the reservoir is so narrowed that a reservoir width, which is situated between the ink supply ports and an opposed wall of the reservoir is substantially equal to a reservoir depth.

2. The ink jet recording head as set forth in claim 1, wherein ink supply ports located in end portions of the reservoir are so arranged that they are closer to an opposed inner wall of the reservoir than are those ink supply ports located in a central portion of the reservoir.

3. The ink jet recording head as set forth in claim 1, wherein an inner wall of the reservoir is so extended that at least one end portion thereof is closer to the ink supply ports than the central portion thereof.

4. The ink jet recording head as set forth in claim 1, wherein a step is formed at least one end portion of an inner wall of the reservoir.

5. The ink jet recording head as set forth in claim 4, wherein the channel unit includes an elastic plate provided on a first surface of the spacer and a nozzle plate provided on a second surface opposed to the first surface, and wherein the step is so formed as to define a gap between the step and the elastic plate.

6. The ink jet recording head as set forth in claim 5, wherein the depth of the gap is narrowed toward the end portion of the reservoir.

7. The ink jet recording head as set forth in claim 1, wherein the distal ends of the ink supply ports constitute one inner wall of the reservoir.

8. The ink jet recording head as set forth in claim 1, wherein the channel unit includes an elastic plate provided on a first surface of the spacer and a nozzle plate provided on a second surface opposed to the first surface, and wherein the ink supply ports are formed only in the first surface of the spacer.

9. The ink jet recording head as set forth in claim 1, wherein the channel unit includes an elastic plate provided on a first surface of the spacer and a nozzle plate provided on a second surface opposed to the first surface, and wherein the ink supply ports are formed in both the first and second surfaces of the spacer.

10. The ink jet recording head as set forth in claim 1, wherein the spacer formed by etching a monocrystal silicon substrate anisotropically.

11. The ink jet recording head as set forth in claim 1, wherein a piezoelectric vibrator serves as the pressurization means.

* * * * *